US005544372A

United States Patent [19]

Garland et al.

[11] Patent Number: 5,544,372

[45] Date of Patent: Aug. 13, 1996

[54] BALL AND SOCKET JOINT, USEFUL WITH COLLAPSIBLE PLAYPENS

[75] Inventors: Thomas A. Garland, Jamestown, R.I.; Robert A. Kolich, East Aurora, N.Y.; Charles W. Paddock, Lancaster, N.Y.; James P. Bicheler, Alden, N.Y.

[73] Assignee: Fisher-Price, Inc., East Aurora, N.Y.

[21] Appl. No.: 339,673

[22] Filed: Nov. 14, 1994

Related U.S. Application Data

[60] Division of Ser. No. 998,370, Dec. 30, 1992, Pat. No. 5,363,521, which is a continuation-in-part of Ser. No. 891, 854, Jun. 1, 1992, abandoned.

[51] Int. Cl.[6] ..... A47D 13/06

[52] U.S. Cl. ..... 5/99.1; 403/90; 403/99; 403/103

[58] Field of Search ..... 5/99.1, 98.1, 98.2; 256/25; 403/103, 99, 90, 100

[56] References Cited

U.S. PATENT DOCUMENTS

| | | | |
|---|---|---|---|
| D. 192,072 | 1/1962 | Hamilton . | |
| D. 193,326 | 8/1962 | Hamilton . | |
| D. 257,299 | 10/1980 | Cone . | |
| D. 304,523 | 11/1989 | Dillner et al. | 5/99.1 |
| D. 323,589 | 2/1992 | Mariol . | |
| 1,374,333 | 4/1921 | Stotler et al. | 5/98.3 |
| 1,413,068 | 4/1922 | Stotler et al. | 5/98.3 |
| 2,254,939 | 9/1941 | Elias | 5/99.1 |
| 2,464,866 | 3/1949 | Holtz | 5/99.1 |
| 2,486,054 | 10/1949 | Morse | 5/99.1 |
| 2,489,188 | 11/1949 | Landry | 5/99.1 |
| 2,498,203 | 2/1950 | Fischer | 5/99.1 |
| 2,523,124 | 9/1950 | Landry | 5/99.1 |
| 2,561,637 | 7/1951 | Rex | 5/99.1 |
| 2,569,937 | 10/1951 | Lindgren | 5/99.1 |
| 2,617,999 | 11/1952 | Mitchell | 5/99.1 |
| 2,624,054 | 1/1953 | Plant | 5/99.1 |
| 2,659,903 | 11/1953 | Hagelfeldt | 5/99.1 |
| 2,675,565 | 4/1954 | Froelich | 5/99.1 |
| 2,688,756 | 9/1954 | Carlson | 5/99.1 |
| 2,710,976 | 6/1955 | Martensen | 5/98.1 |
| 2,733,453 | 2/1956 | Cifarelli | 5/99.1 |
| 2,769,183 | 11/1956 | Froelich | 5/99.1 |
| 2,781,527 | 2/1957 | Landry | 5/99.1 |
| 2,784,420 | 3/1957 | Moltane | 5/98.1 |
| 2,814,051 | 11/1957 | Lee et al. | 5/99.1 |
| 2,825,071 | 3/1958 | Landry et al. | 5/99.1 |
| 2,851,701 | 9/1958 | Lukala | 5/99.1 |
| 2,901,755 | 9/1959 | Wood, Jr. | 5/99.1 |
| 2,908,021 | 10/1959 | Fulton | 5/99.1 |
| 2,922,169 | 1/1960 | Werner | 5/98.1 |
| 3,018,493 | 1/1962 | Wittbrodt | 5/99.1 |
| 3,040,341 | 6/1962 | Hesketh et al. | 5/99.1 |
| 3,063,065 | 11/1962 | Shaw | 5/99.1 |
| 3,064,277 | 11/1962 | Gill | 5/98.1 |
| 3,092,847 | 6/1963 | De Puy | 5/99.1 |
| 3,095,583 | 7/1963 | Golub et al. | 5/99.1 |
| 3,103,670 | 9/1963 | Landry | 5/99.1 |
| 3,119,124 | 1/1964 | Krauss | 5/99.1 |
| 3,127,620 | 4/1964 | Peterson | 5/99.1 |
| 3,158,876 | 12/1964 | Gottlieb | 5/99.1 |
| 3,163,870 | 1/1965 | Scotney, III | 5/99.1 |

(List continued on next page.)

FOREIGN PATENT DOCUMENTS

| | | |
|---|---|---|
| 1557841 | 2/1969 | France . |
| 2361846 | 3/1978 | France . |

*Primary Examiner*—Alexander Grosz
*Attorney, Agent, or Firm*—C. Scott Talbot; Howrey & Simon

[57] ABSTRACT

A ball and socket joint for connecting one end of a rail member to a base member includes a ball mounted on the end of the rail member. A socket and a radial slot in the base member permit pivoting of the rail section relative to the base between a first position and a second position. The socket also permits rotation of the ball in the socket to permit rotation of the rail member about its longitudinal axis relative to the base member between a locked orientation and a unlocked orientation. When the rail section is in the locked orientation it cannot pivot relative to the base member and when the rail section is in the unlocked position it is free to pivot relative to the base member.

13 Claims, 8 Drawing Sheets

U.S. PATENT DOCUMENTS

| | | | |
|---|---|---|---|
| 3,165,760 | 1/1965 | Abajian | 5/99.1 |
| 3,183,528 | 5/1965 | Jacobs et al. | 5/99.1 |
| 3,187,352 | 6/1965 | Gottlieb | 5/99.1 |
| 3,206,772 | 9/1965 | Sarasin | 5/99.1 |
| 3,206,773 | 9/1965 | Sarasin | 5/99.1 |
| 3,233,254 | 2/1966 | Golub et al. | 5/99.1 |
| 3,309,718 | 3/1967 | Sarasin | 5/98.1 |
| 3,430,273 | 3/1969 | Stillwaugh | 5/98.1 |
| 3,474,472 | 10/1969 | Hamilton, II | 5/98.1 |
| 3,606,620 | 9/1971 | Glover | 5/99.1 |
| 3,789,439 | 2/1974 | Berg et al. | 5/99.1 |
| 3,800,341 | 4/1974 | Davanzo | 5/99.1 |
| 3,801,208 | 4/1974 | Bourgraf et al. | 403/102 |
| 3,886,607 | 6/1975 | Dunn | 5/99.1 |
| 3,924,280 | 12/1975 | Vaiano | 5/99.1 |
| 4,008,499 | 2/1977 | Wren, Jr. et al. | 5/99.1 |
| 4,069,524 | 1/1978 | Carlo | 5/99.1 |
| 4,070,716 | 1/1978 | Satt et al. | 5/99.1 |
| 4,186,454 | 2/1980 | Cone | 5/99.1 |
| 4,202,065 | 5/1980 | Sullivan | 5/99.1 |
| 4,304,017 | 12/1981 | Mortimer | 5/99.1 |
| 4,357,735 | 11/1982 | Saint et al. | 5/99.1 |
| 4,376,318 | 3/1983 | Cirillo | 5/99.1 |
| 4,455,697 | 6/1984 | Rovida | 5/99.1 |
| 4,493,120 | 1/1985 | Watts | 5/99.1 |
| 4,532,674 | 8/1985 | Tobey et al. | 16/295 |
| 4,561,138 | 12/1985 | Hwang | 5/99.1 |
| 4,573,224 | 3/1986 | Saint | 5/99.1 |
| 4,635,305 | 1/1987 | Wyss | 5/99.1 |
| 4,645,370 | 2/1987 | Kassai | 403/56 |
| 4,651,367 | 3/1987 | Osher et al. | 5/99.1 |
| 4,669,138 | 6/1987 | Kassai | 5/99.1 |
| 4,683,600 | 8/1987 | Berger | 5/99.1 |
| 4,688,280 | 8/1987 | Kohus et al. | 5/99.1 |
| 4,692,953 | 9/1987 | Fetters | 5/99.1 |
| 4,702,719 | 10/1987 | Lapid | 16/374 |
| 4,703,525 | 11/1987 | Shamie | 5/99.1 |
| 4,710,049 | 12/1987 | Chang | 5/99.1 |
| 4,811,437 | 3/1989 | Dillner et al. | 5/99.1 |
| 4,819,285 | 4/1989 | Fetters | 5/99.2 |
| 4,837,875 | 6/1989 | Shamie et al. | 5/99.1 |
| 4,934,025 | 6/1990 | Mariol | 5/99.1 |
| 5,214,716 | 9/1993 | Kohus | 5/99.1 |
| 5,217,315 | 6/1993 | Rosanne | 403/100 |
| 5,363,521 | 11/1994 | Garland et al. | 5/99.1 |

BALL AND SOCKET JOINT, USEFUL WITH COLLAPSIBLE PLAYPENS

This application is a division of application Ser. No. 07/998,370, filed on Dec. 30, 1992 now U.S. Pat. No. 5,363,521, which is a continuation-in-part of application Ser. No. 07/891,854 filed on Jun. 1, 1992, abandoned. The present invention relates to playpens, and more particularly, to a readily collapsible playpen movable between a collapsed and an open position.

BACKGROUND OF THE INVENTION

U.S. Pat. No. 4,376,318 to Cirillo discloses a portable playpen wherein the foldable playpen includes upper and lower retaining frames separated by vertical members. The end or side of the vertical structure members fold inwardly and released vertical members to provide a compact arrangement for carrying.

U.S. Pat. No. 4,837,875 to Shamie et al. discloses a folding playpen with attached fabric enclosure. A playpen includes a frame having floor supports with inner ends which are connected to each other by a hub that permits swinging of the floor supports in a horizontal plane from an in use position to a folded position. The uprights are connected by hinges to the outer ends of the floor supports. Bendable sides and end rails interconnect the tops and bottoms of the uprights. One of the cross-members can be removed whereas provided with a mechanism to permit its elongation, such that the frame can be folded with all other parts permanently connected to each other and without removing the fabric enclosure.

U.S. Pat. No. 4,070,716 to Satt et al. discloses a foldable playpen having two end portions and two side portions which are interconnected to form a substantially square frame. The two end portions are pivotal in a downward direction toward a center vertical leg located at each end and the side portions are pivotal inward bringing the two folded end portions together, to thereby fold the playpen.

SUMMARY OF THE INVENTION

The present invention provides a foldable playpen having a novel construction for permitting easy folding of the playpen.

Specifically, the present playpen includes a first end assembly and a second end assembly, wherein each end assembly includes an end base for contacting a support surface and an upright frame. The upright frame of each end assembly includes articulated uprights which extend upward from the end base and terminate at an upper cross bar, wherein the articulated uprights selectively space the upper cross bar from the base of the end assembly.

An embodiment of the present playpen also includes lower articulated rails extending between the end bases for disposing the end bases in a parallel spaced apart orientation in the open position and a parallel adjacent orientation in the collapsed position.

The collapsible playpen further includes upper articulated rails extending between the upper cross bars of each end assembly, wherein the upper articulated rails permit rotation of the upper cross bars relative to the corresponding end base, while the upper cross bars remain parallel to each other and the corresponding end base.

The articulated uprights and the upper and lower articulated rails are adapted to orient the upper cross bar and the end base within each end assembly in a spaced apart parallel orientation in the operative position and an adjacent parallel orientation in the collapsed position, wherein the distance between the parallel upper cross bars is greater than the distance between the parallel end bases in the collapsed position in the playpen.

In another aspect, the invention provides a ball and socket joint for connecting one end of a rail member to a base member that includes a ball mounted on the end of the rail member. A socket and a radial slot in the base member permit pivoting of the rail section relative to the base member between a first position and a second position. The socket also permits rotation of the ball in the socket to permit rotation of the rail member about its longitudinal axis relative to the base member between a locked orientation and a unlocked orientation. When the rail section is in the locked orientation it cannot pivot relative to the base member and when the rail section is in the unlocked position it is free to pivot relative to the base member.

DETAILED DESCRIPTION OF THE PREFERRED EMBODIMENT

Figure 1:
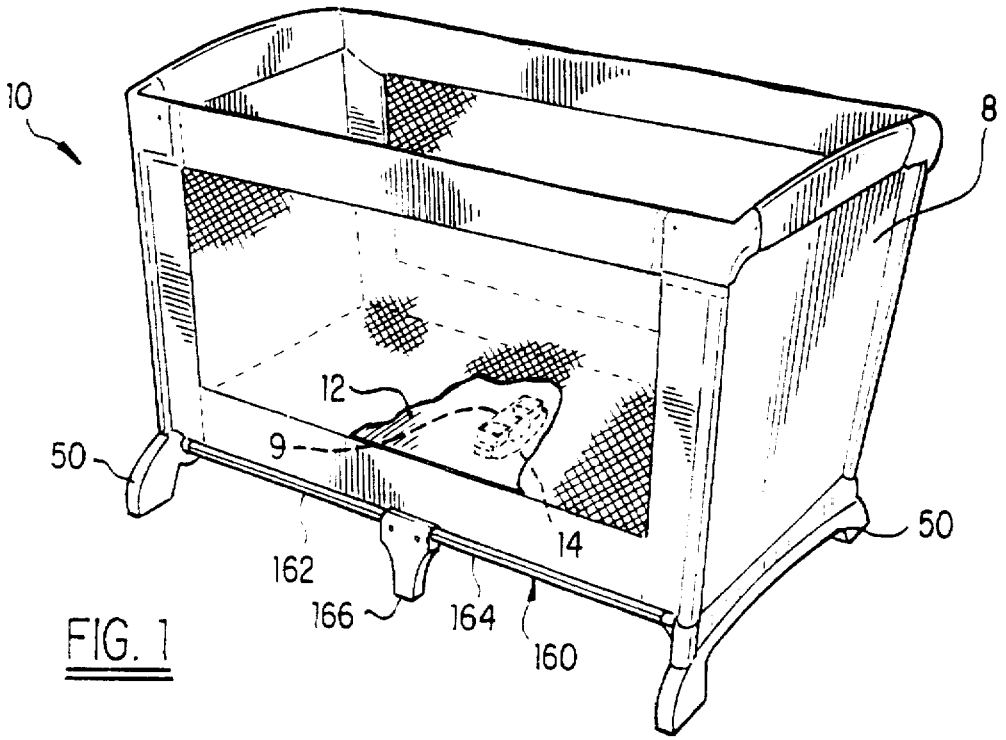
FIG. 1 is a perspective view of the present invention in the open configuration position.
Figure 2:
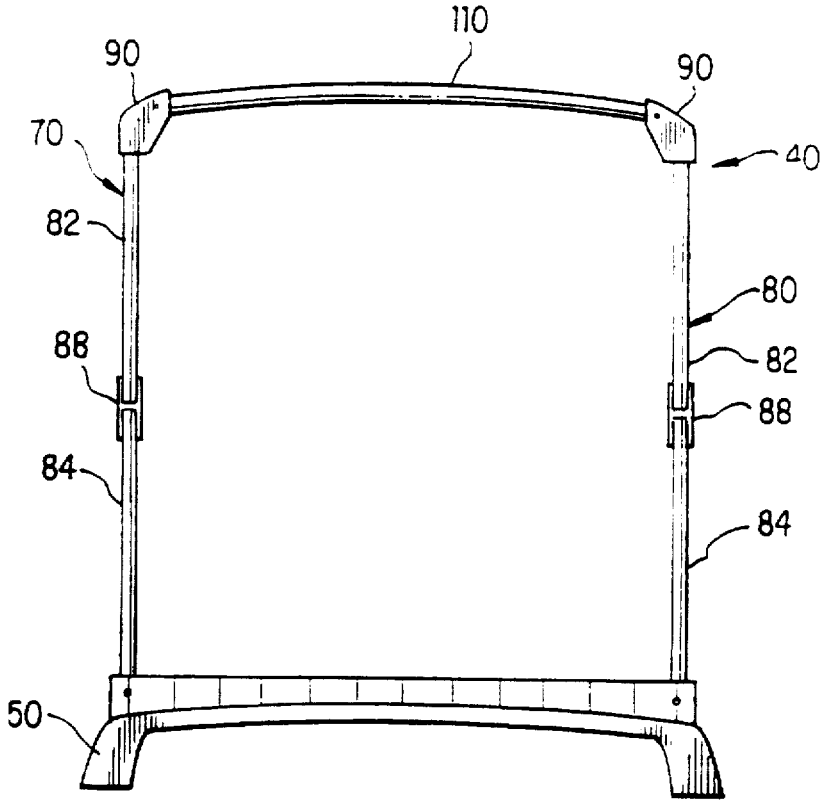
FIG. 2 is an end view of the collapsible frame of the present invention in open configuration.
Figure 3:
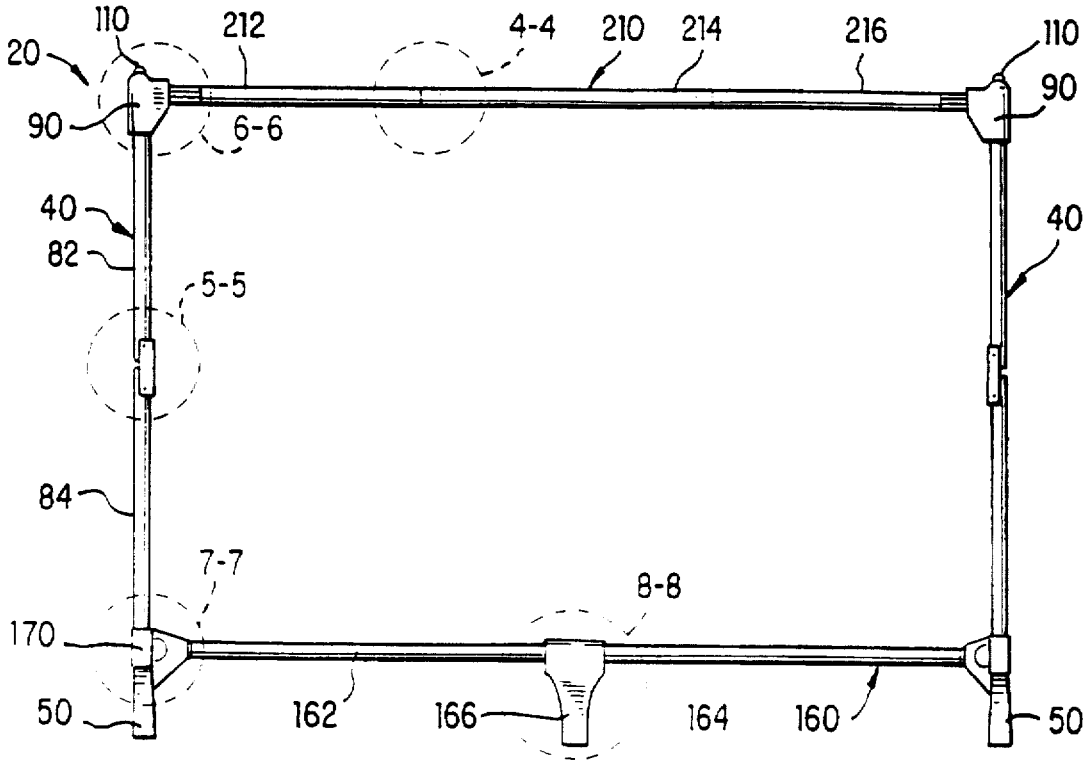
FIG. 3 is a side elevational view showing the frame of the present invention in the open configuration.

Referring to FIGS. 1–3, the playpen 10 of the present invention is shown in an open, operative position. The playpen 10 includes a fabric enclosure 8 cooperatively engaged to a frame 20. The fabric enclosure 8 defines an operative volume of the playpen for occupancy by a child. The fabric enclosure 8 has mesh side walls and solid, or opaque, end walls and floor.

Referring to FIGS. 1–3, the frame 20 includes a first and second end assembly 40. The end assemblies 40 define an operative volume 30 intermediate of the end assemblies. Each end assembly, 40 includes an end base 50 for contacting a support surface, a collapsible upright end frame 70 and an upper cross bar 110. The end bases 50 of the end assemblies 40 are parallel to each other and connected by a pair of lower articulated rails 160. The upper cross bars 110 of the end assemblies 40 are interconnected by a pair of upper articulated rails 210.

As shown in FIG. 1, 3, 7 and 8, each lower articulated rail 160 includes a pair of rail sections 162,164 and a central coupler 166. One end of each rail section 162,164 is pivotally attached to the central coupler 166. The remaining ends of the rail sections 162,164 are connected to opposing end bases 50. The connection between the rail section 162,164 and the end base 50 provides for pivoting of the rail section relative to the base and rotation of the rail section about its longitudinal axis.

Figure 7A:
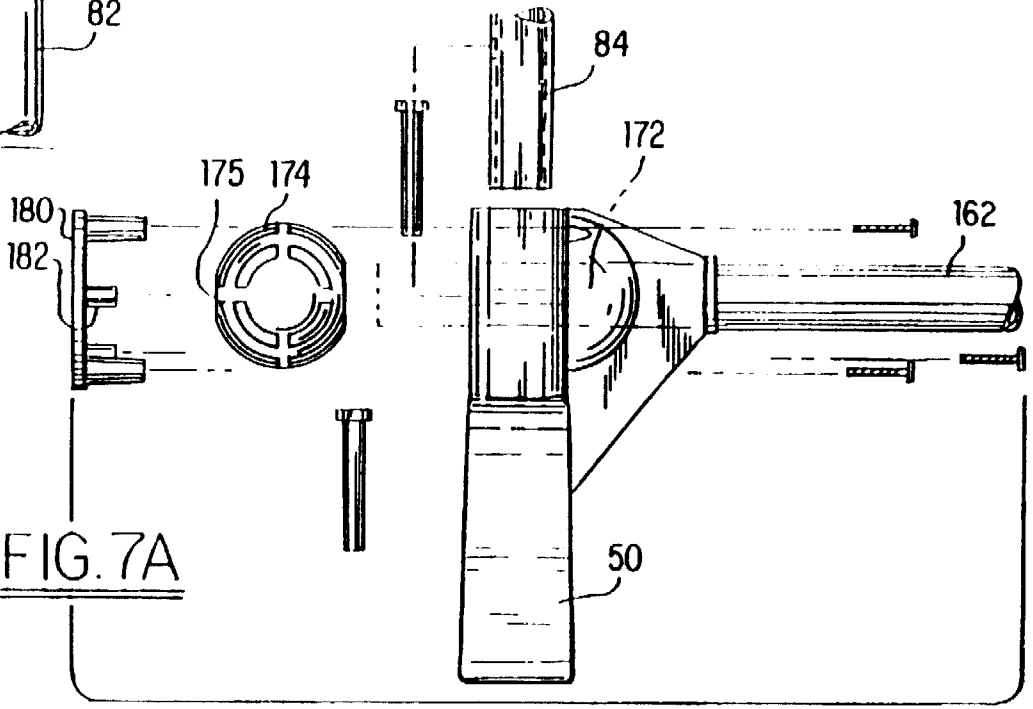
FIGS. 7, 7*a*, 7*b* and 7*c* are enlarged views of the joint indicated by lines 7—7 of FIG. 3.
Figure 7:
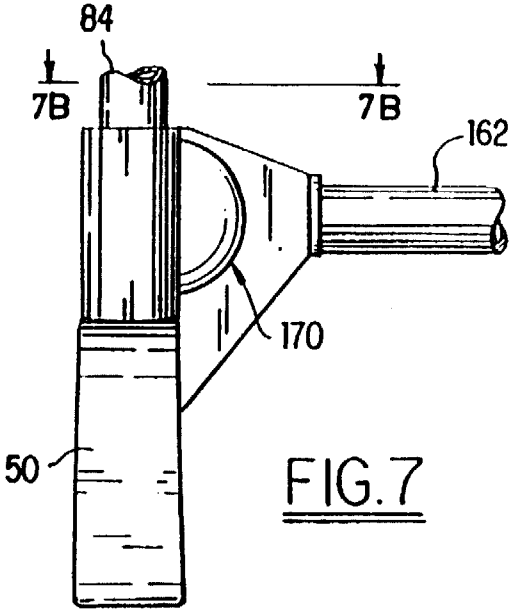
Figure 7B:
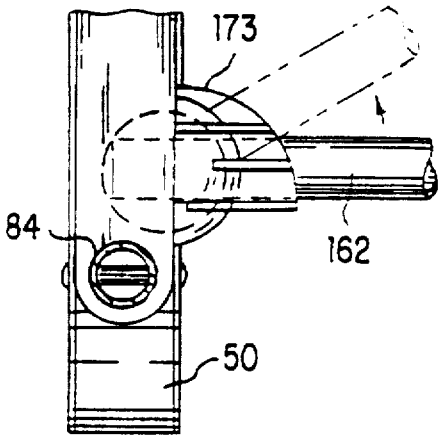
Figure 7C:
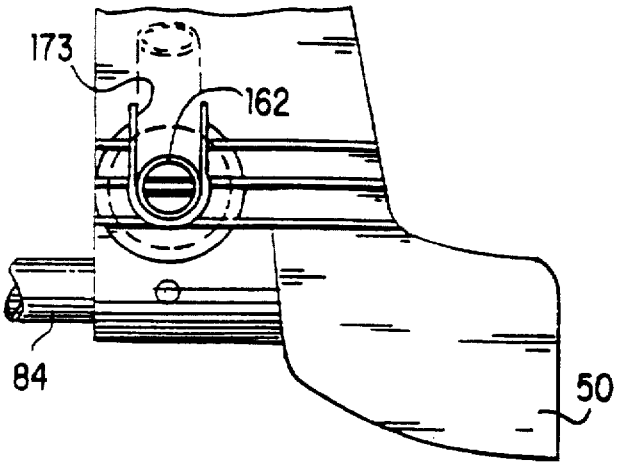

Referring to FIGS. 7–7*c*, the connection of the lower articulated rail 160 to the end base 50 generally employs a ball and socket joint 170. The base includes a socket 172 having a radial slot 173 sized to receive a portion of the rail section 162,164. The end of the rail section extends through the slot 173 and is fixedly attached to a ball 174. The ball 174 is retained with the socket 172 by a retaining plate 180 on the outside of the end base 50. The retaining plate 180 may be glued, screwed or welded to the end base 50 to capture the ball 174 within the socket 172. The ball 174 includes a generally T-shaped groove 175 in the outer surface of the ball. The retaining plate 180 includes an elongated tab 182 sized to the be received within the groove 175. The groove 175 and the tab 182 are configured so that upon orientation of the central coupler 166 as shown in FIGS. 1, 3 and 8, the ball 174 cannot pivot within the socket 172, and upon rotation of the coupler 166 as shown in FIGS. 8*c* and 8*d*, the rail sections 162,164 rotate about their longitudinal axis and the tab 182 aligns with the length of the T groove 175 to permit pivoting of the ball 174 within the socket 172 as the tab slides along the groove.

The outer ends of each rail section 162,164 are thereby rotatably and pivotally affixed to an end base 50. The rail sections 162,164 may pivot from the open position perpendicular to the end base 50 to the collapsed position parallel to the end base.

Figure 8A:
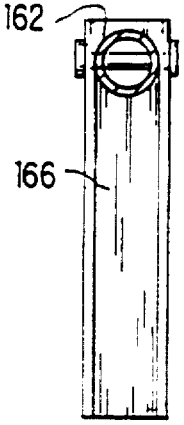
FIGS. 8, 8*a*, 8*b*, 8*c* and 8*d* are enlarged views of , and show the relative motion of the two-way coupling indicated by lines 8—8 of FIG. 3.
Figure 8:
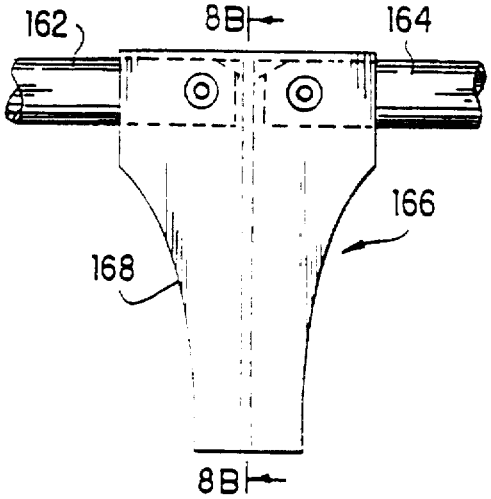
Figure 8B:
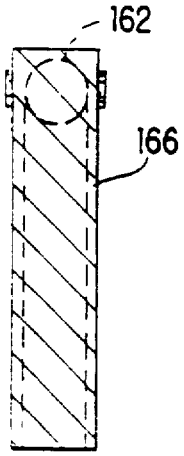
Figure 8C:
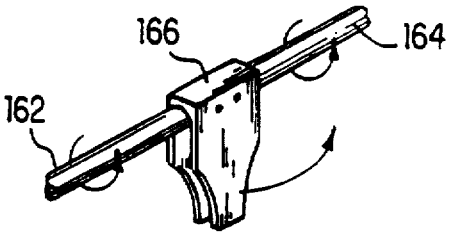
Figure 8D:
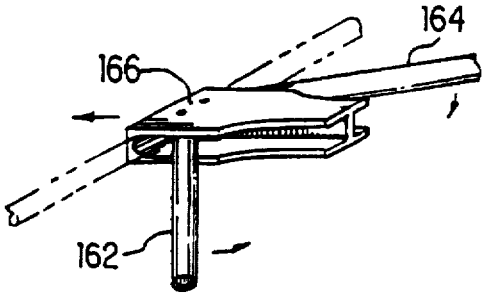

As shown in FIGS. 8—8*d*, the inner end of each rail section 162,164 is pivotally attached to the central coupler 166. The central coupler 166 includes a depending portion 168 for contacting the supporting surface while retaining the rail sections 162,164 in a substantially horizontal orientation. The rail sections 162,164 are pivotally attached to the central coupler 166 to pivot about an axis transverse to the length of the rail section. Therefore, as the central longitudinal axis coupler 166 is rotated about an axis which is transverse to the pivot axis between the rail sections 162,164 and the coupler, the rail sections rotate about their longitudinal axis. The attachment to the central coupler 166 permits pivoting of the rail sections relative to the central coupler. The central coupler 166 may rotate the rail sections 162,164 about their longitudinal axis, then permit pivoting of the rail section relative to the central coupler.

The rail sections 162,164 rotate about their longitudinal axis with respect to the end base 50, as the depending portion 168 of the central coupler 166 is rotated from the support surface. The rail sections rotate about their longitudinal axis, thereby aligning the tab 182 and the T-groove 173 to permit pivoting of the rail section relative to the end base.

Referring to FIGS. 2, 3, 5 and 5A, a collapsible upright end frame 70 extends upward from each end base 50 to support the upper cross bar 110. The upright end frame 70 includes a collapsible upright 80 extending from each end of the end base 50 to the ends of the upper cross bar 110. Each upright 80 includes an upper and lower upright section, 82 and 84 respectively, and a one-way hinge 88. The upper cross bar 110 extends between the tops of the collapsible uprights 80 and is fixedly attached thereto. Preferably, the intersection of the cross bar 110 and the uprights 80 includes a bracket 90.

The end assembly 40 may be described as having a lower end including the end base 50 and lower upright sections 84, and an upper end portion which includes the upper upright sections 82 and the cross bar 110. That is although depicted as separate components, the end base 50 and lower upright 84 may form a single lower end portion of the end assembly.

As shown in FIGS. 7 and 7A, the bottom of each lower upright section 84 is fixedly attached to the end base 50 and extends vertically from the end base. The top of the lower upright section 84 is pivotally attached to the hinge 88. The hinge 88 is an elongated U-shaped member sized to receive the diameter of the upright sections 82,84 between the legs of the hinge. The bottom of the upper upright section 82 is also pivotally attached to the hinge 88. As shown in FIGS. 2, 3, 5 and 5*a*, the closed portion of the hinge 88 is disposed towards the opposing end assembly 40. Therefore, as the upper upright sections 82 within each end assembly 40 rotate about the hinge 88, the upper upright sections 82 initially rotate away from the opposing end assembly. While the cross bars 110 rotate away, the cross bars do not move away from each other. That is, the absolute distance between the cross bars does not increase upon rotation of the cross bars 110 about hinges 88. The hinges 88 permit folding of the articulated uprights 80 about the hinge by rotating the upper upright sections 82 away from the plane of the opposing end assembly 40. The upper upright sections 82 within a given end assembly 40 are fixedly connected to the upper cross bar 110 and include the brackets 90, and folding about the hinges 88 permits the upper cross bar 110 to initially rotate in a direction away from the opposing end assembly 40.

Figure 6A:
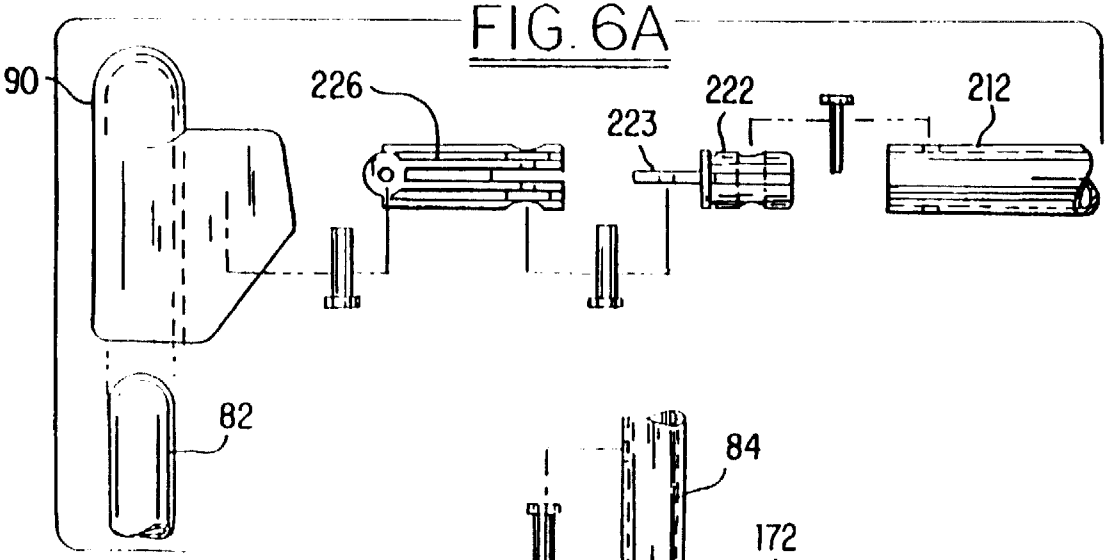
FIGS. 6 and 6*a* are enlarged views of the joint indicated by lines 6—6 of FIG. 3.
Figure 6:
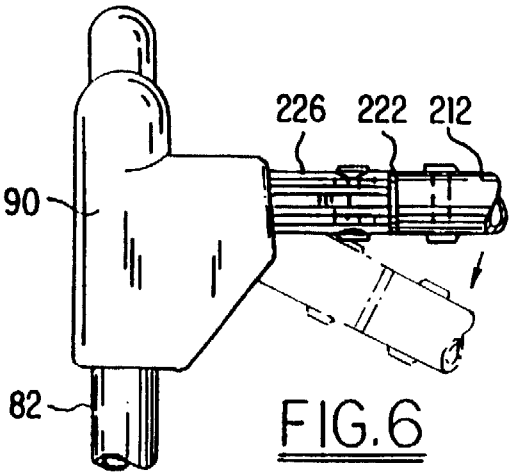

Referring to FIGS. 2, 3 and 6, the corner bracket 90 allows for interconnection of the upright 80 the upper cross bar 110 and the upper articulated rails 210.

The upper articulated rails 210 extend between the upper cross bars 110 of the opposing end assemblies 40 to form collapsible side rails. As shown in FIG. 3, each upper rail 210 has three segments, including two outer segments 212,216 and an intermediate segment 214. The outer end of each outer segment 212,216 is pivotally attached to a corner bracket 90 to permit rotation of the end segment towards the upper upright section 82 of the corresponding upright 80 and towards the corresponding upper cross bar 110.

Referring to FIG. 6 and 6*a*, the outer segments 212,216 bi-directionally rotate relative to the corner brackets 90. The outer ends of the outer segments 212,216 are fixedly attached to a first blade 222. The first blade 222 includes an aperture 223. The first blade 222 is pivotally connected to a second blade 226, such that the second blade is perpendicular to the first blade. The second blade 226 is pivotally attached to the corner bracket 90 about an axis which is substantially parallel to the length of the upper cross bar 110. Therefore, the outer segment 212,216 may be rotated downward towards the corresponding upper upright section 82, or horizontally towards the corresponding upper cross bar 110.

Figure 4:
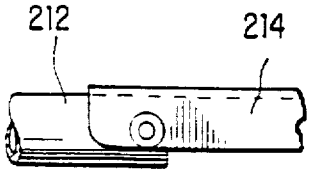
FIGS. 4 and 4*a* are enlarged views of the coupling indicated by lines 4—4 in FIG. 3.
Figure 4A:
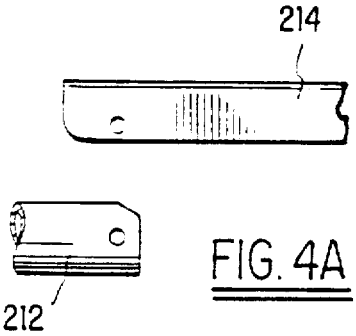
Figure 5:
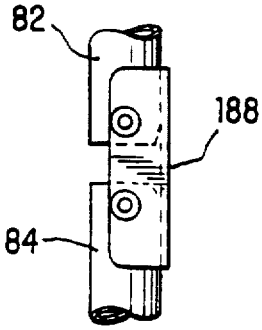
FIGS. 5 and 5*a* are enlarged views of the coupling indicated by lines 5—5 in FIG. 3.
Figure 5A:
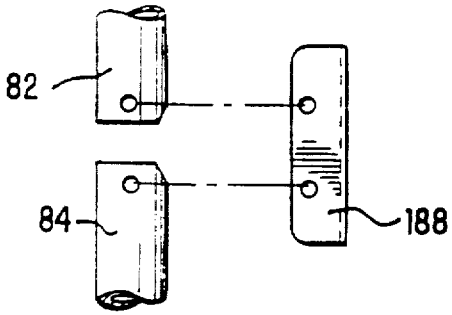

Referring to FIGS. 4 and 4a, the remaining end of each outer segment 212,216 is pivotally connected to the intermediate segment 214. The intermediate segment 214 is a substantially U-shaped member sized to receive the diameter of the outer segments 212,216 within the U. The closed portion of the U shape is disposed upwards, such that the outer segments 212,216 may pivot downwards with respect to the intermediate segment 214. The intermediate segments 214 permit folding of the outer segments 212,216 about the intermediate segment Co permit rotation about an axis parallel to the upper cross bars 110, or ends of the playpen 10.

In the open position, the supporting end bases 50 are spaced apart in a parallel orientation. The lower articulated rails 160 extend between the end bases 50 and are substantially perpendicular to the end bases. The central couplers 166 are oriented such that the depending portion 168 contacts the supporting surface. The rail sections 162,164 within each lower articulated rail 160 are colinear. The lower articulated rails 160 and end bases 50 form a rectangular periphery.

In the open position of the playpen 10, the uprights 80 in each end assembly orient the upper cross bar 110 above and parallel to the end base 50. The upper and lower sections 82,84 within of each upright 80 are colinear, such that all uprights of the playpen are parallel and vertical.

The upper articulated rails 210 extend between the upper cross bars 110 of each end assembly 40 such that the outer sections 212,216 and intermediate section 214 of each upper articulated rail are colinear, and the upper articulated rails are parallel to each other and perpendicular to the upper cross bar. The upper rails 210 cannot be rotated downward as such rotation would require rotation in a direction which is precluded by the hinges in the uprights 80. That is, the interconnection of all the joints are self-locking in the open position of the playpen 10. Similarly with the playpen 10 in the open position, upright 80 cannot fold about hinge 88 as such motion in such direction is precluded by the lower articulated rails 160 and opposing end assembly 40 which retain the end bases 50 in the spaced apart relationship.

The fabric enclosure 8 encloses five of the six sides of the rectangle defined by the collapsible frame 20. The fabric enclosure 8 includes sleeves for surrounding each upright 80 between the end base 50 and the corner bracket 90; each upper cross bar 110; and each upper articulated rail 210. The fabric enclosure 8 does not surround the lower articulated rails 160 or the end bases 50. The bottom of the fabric enclosure includes a central aperture 9.

In the open position, a mat 12 is disposed within the bottom of the fabric enclosure 8 to substantially define bottom periphery of the playpen 10. The mat 12 includes a depending handle 14 sized to pass through the aperture 9 in the bottom of the fabric enclosure 8. The engagement of the handle 14 in the central aperture 9 retains the mat 12 with respect to the fabric enclosure and prevents the mat from sliding relative to the bottom of the enclosure.

In a preferred embodiment, each of the lower rail sections 162,164 has a length of approximately 17 inches, and the central coupler 166 has a length of approximately 3". The lower upright section 84 extends upward to terminate approximately 10" from the end base 50. The hinge 88 has an effective length of approximately two inches, and the upper upright section 82 extends for a length of approximately 13 inches. Each of the outer segments 212,216 of the upper articulated rail extends approximately 13.5" from the corner bracket 90. The intermediate segment has an effective length of approximately 10". The end bases 50 and upper cross bars 110 define a width of approximately 24".

To collapse the playpen 10, the mat 12 is removed from the bottom of the fabric enclosure 8. The collapsing of the playpen is shown schematically in FIGS. 9–12 wherein the reference numbers are indicated by prime accents. That is, central coupler 166 is referred to in FIGS. 9–12 as central coupler 166'.

The locking mechanism, described infra is released and the central couplers 166' of the lower articulated rails 160' are rotated so as to rotate the rail sections 162' 164' about their longitudinal axes. As the rail sections 162', 164' rotate about their longitudinal axis, the groove 175 in the ball 174 is realigned with respect to the tab 182 on the retaining plate 180, thereby permitting pivoting of each rail section 162', 164' relative to the respective end base 50'. That is, after rotation of the central coupler 166', the couplers are pushed towards each other so as to decrease the distance between the parallel end bases 50' as shown in FIGS. 10–12.

Figure 9:
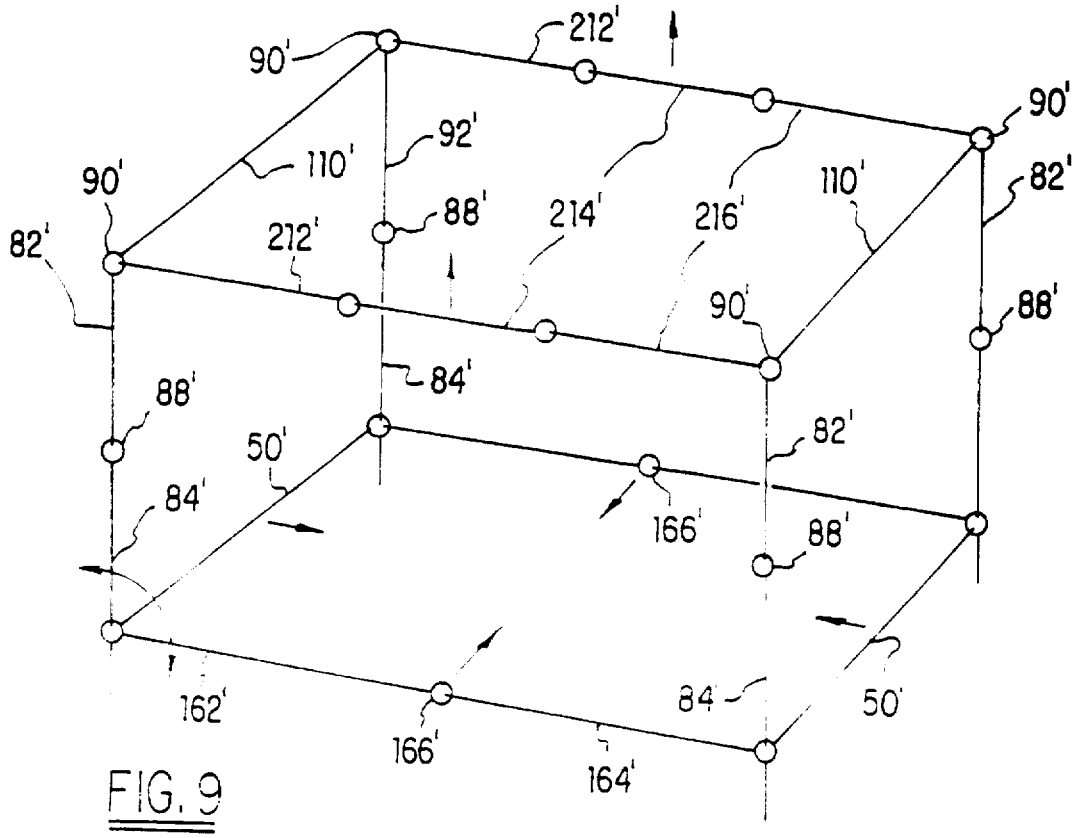
FIG. 9 is a schematic view of the collapsible frame in the erect position.
Figure 10:
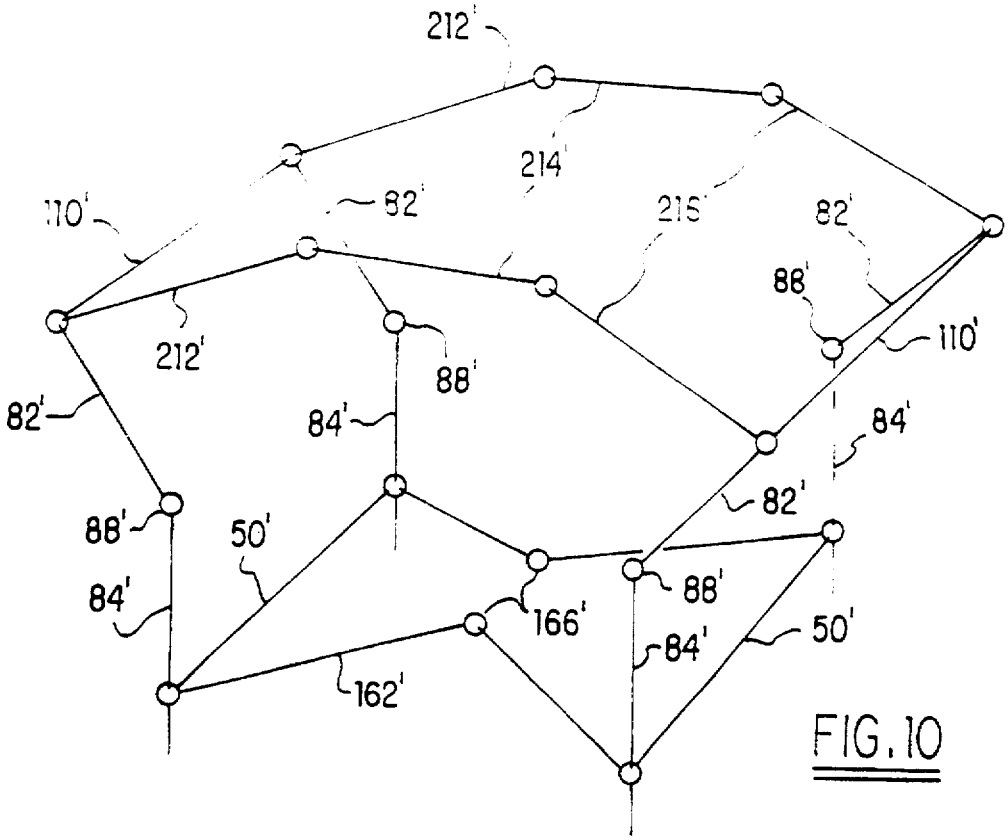
FIG. 10 is a schematic view of the collapsible frame in a partially collapsed position.

Referring to FIGS. 9 and 10, as the distance between the end bases 50' decreases, the absolute distance between the upper portions of the end assemblies also decreases. However, the distance between the end bases 50' decreases more than distance between the upper cross bars 110'.

The outer segments 212', 216' of the upper articulated rails pivot towards corresponding upper upright sections 82'. As the distance between the end bases 50' decreases more than the distance between the upper cross bars 110', the upper cross bars are rotated away from each other. The rotation of the upper cross bars 110' is permitted by the folding of the outer segments 212', 216' about the intermediate segment 214' and the folding of the upper upright section 82' about the hinge 88'.

Figure 11:
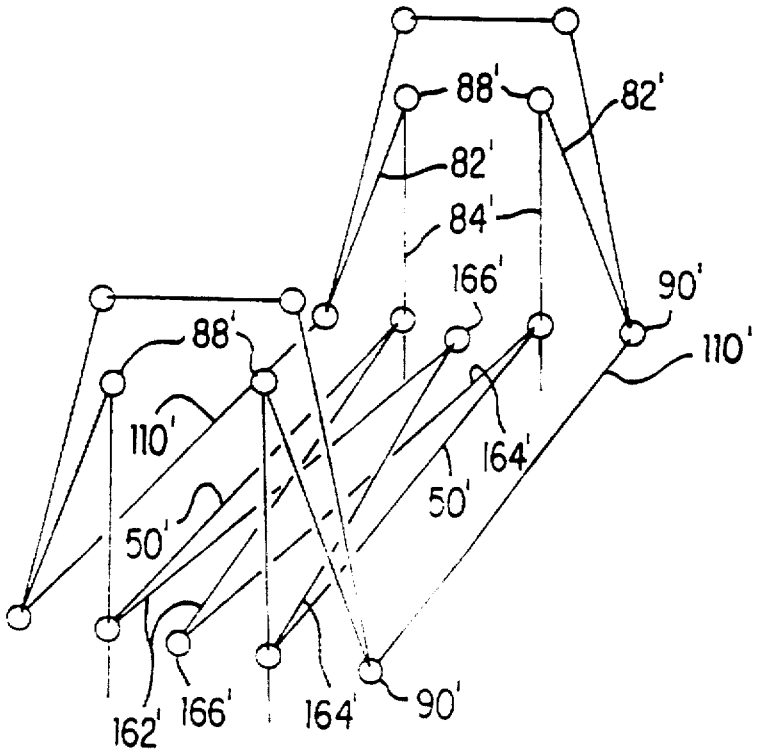
FIG. 11 is a schematic view of the collapsible frame in substantially collapsed position.
Figure 12:
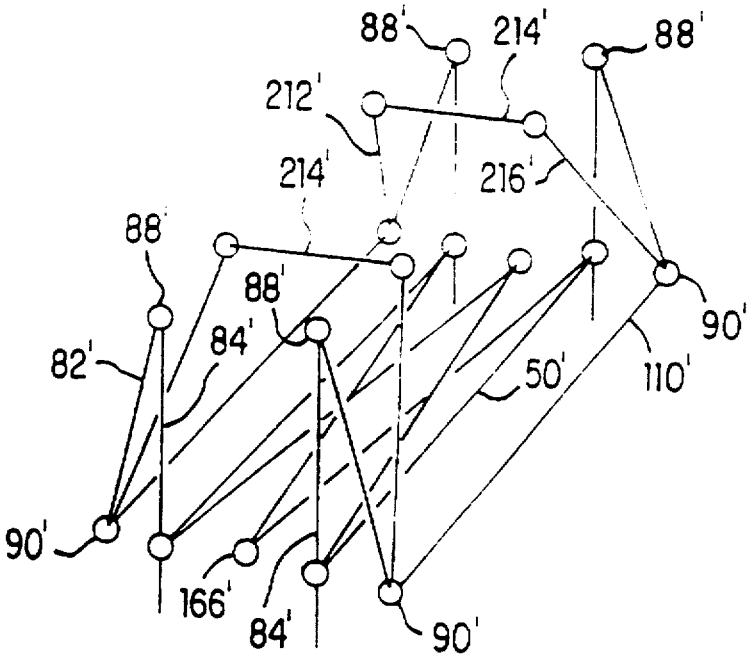
FIG. 12 is a schematic view of the collapsible frame in its completely collapsed position.
Figure 13:
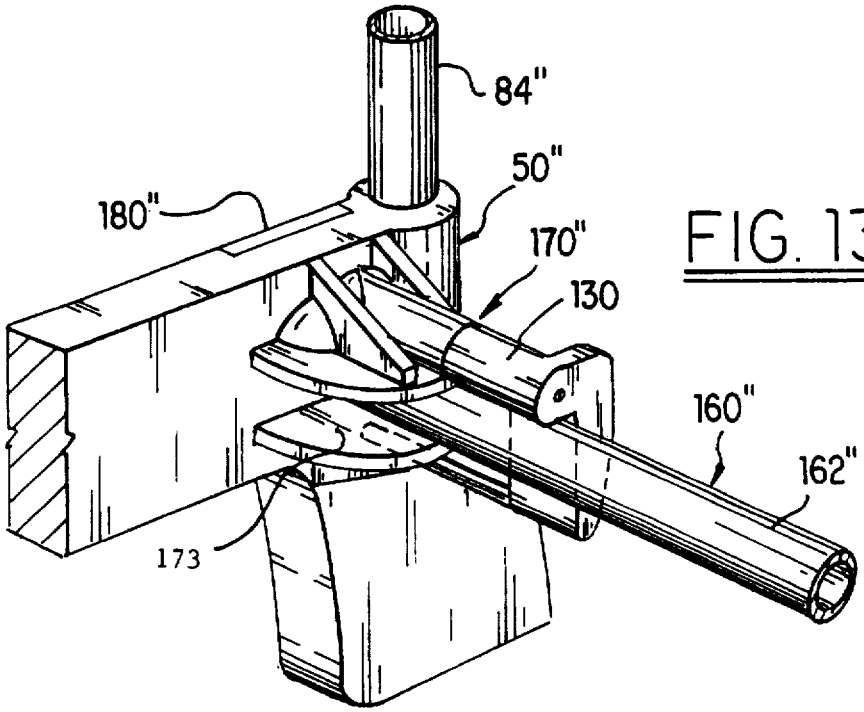
FIG. 13 is a perspective view of the locking mechanism in the open position.

Referring to FIGS. 10 and 11, as the end bases 50' are further drawn together, the central couplers 166' of each lower articulated rail approach the opposing side of the playpen. That is, as shown in FIGS. 10 and 11 the rail sections 162', 164' within each lower articulated rail approach a parallel orientation. As the end bases 50' are drawn adjacent to each other, the upper cross bars 110' continue pivoting about the hinge 88' to be disposed outside of, and adjacent their respective end base 50.

As the end bases 50' are drawn together, the upper end portions are initially rotated away from each other to be separated by a distance greater than the distance between the end bases.

Finally, referring to FIG. 12, the intermediate segments 214' of the upper articulated rails may be rotated towards each other. To permit this rotation the bi-directional pivot of the outer segments relative to the corner bracket 90 permits the intermediate sections 214' to be disposed towards each other while remaining in a parallel orientation.

The present construction provides a playpen 10 which is self supporting in the operative position. However, as the occupant of the playpen may outweigh the playpen 10 itself, it may be desirous to include a releasable latch or locking mechanism 130 for retaining the playpen in the operative position. The locking mechanism 130 may cooperate with the playpen 10 in a variety of configurations. Referring to FIGS. 13–16, for example, the locking mechanism may be incorporated into the ball and socket joint 170, or the uprights 80.

The description of the locking mechanism 130 will include components corresponding to those previously described. Therefore, the corresponding components will be designated by double primes (''). Application of the locking mechanism 130 in the ball and socket joint 170'' cooperates with the lower articulated rail 160'' and the end base 50''. The retaining plate 180'' includes the projecting tab 182'' which is colinear with the lower articulated rail 160'' in the operative position.

Figure 14:
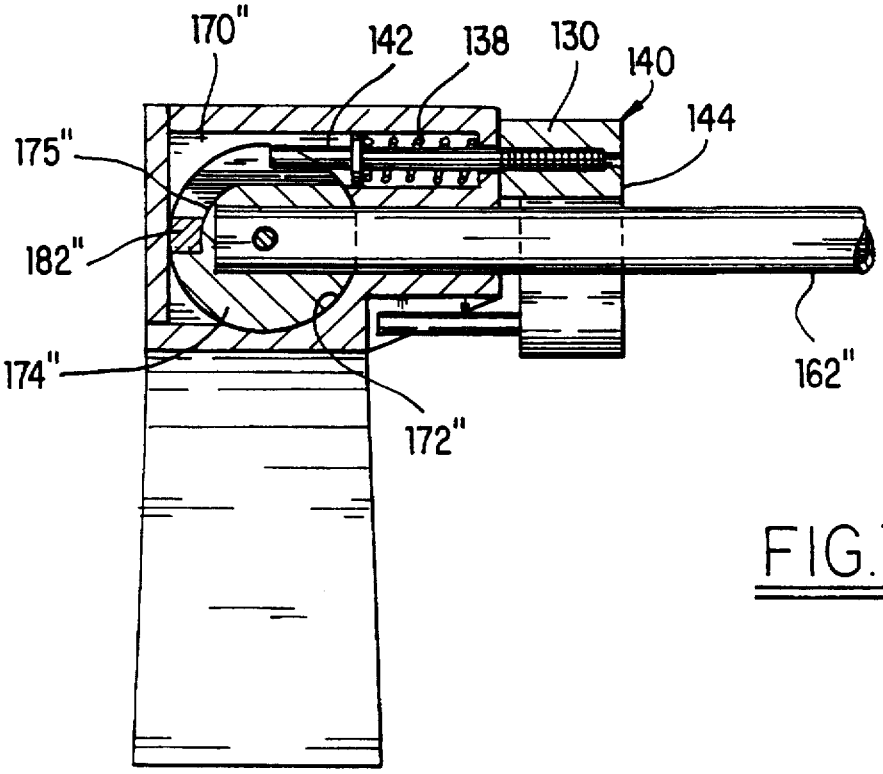
FIG. 14 is a side elevational partial cross sectional view of the locking mechanism in the open position.
Figure 15:
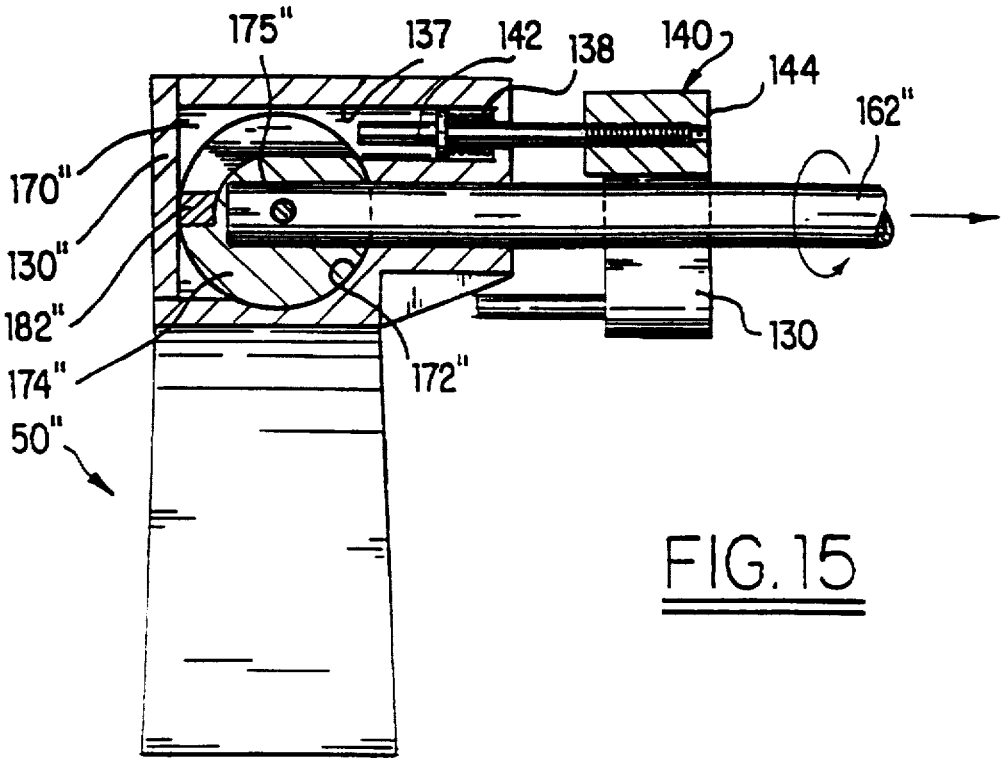
FIG. 15 is a side elevational partial cross sectional view showing the locking mechanism in a release position.
Figure 16:
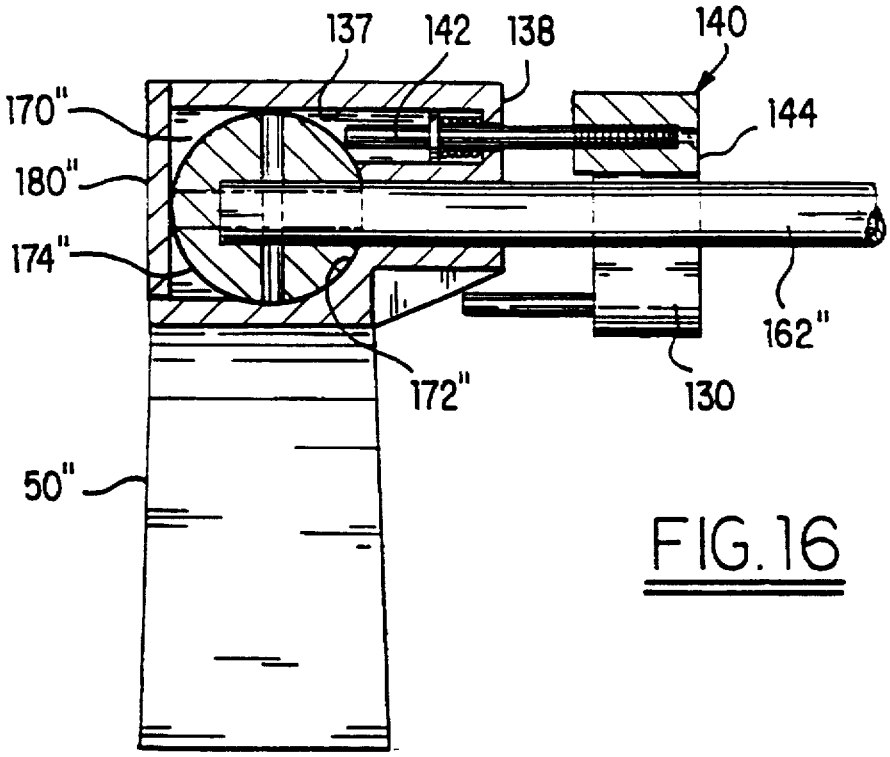
FIG. 16 is a side elevational cross sectional view showing the locking mechanism in the release position after rotation of a rail section.

As shown in FIGS. 14–16, the ball 174'' includes a peripheral groove 175'' sized to slidably receive the tab 182''. The base 50'' includes a passageway 137 which intersects the socket 172''. A catch 140 is disposed within the passageway 137 and a spring 138 biases the catch 140 toward the socket 172''. The catch 140 includes an elongate portion 142 for movement within the passageway 137 and a handle portion 144. The elongate portion 142 contacts the surface of the ball 174''.

Operation

In the collapsed position, the catch 140 is contacting the outer surface of the ball 174'' and the ball is oriented such that the tab 182'' is within the groove 175''. As the rail section 162'' is pivoted, the ball 174'' rotates and the tab 182'' slides in the groove 175'', until the tab is substantially colinear with the rail section. Referring to FIG. 15, the rail section 162''(and ball 174'') are then rotated about the longitudinal axis of the rail section 162''. As rotation occurs, the elongate portion 142 of the catch 140 which is urged against the periphery of the ball 174'' continues to contact the ball. Rotation continues until the groove 175'' aligns with the passageway 137, and the elongate portion 142 of the catch 140 is driven into the groove 175'' by the spring bias. Pivoting of the rail section 162'' about its terminal end, is precluded by cooperation of the tab 182'' and the groove 175,'' rotation of the rail section about its longitudinal axis is precluded by engagement of the catch 140 and the groove 175''.

To collapse the playpen, the handle portion 144 is used to pull the elongate portion 142 from within the groove 175''. Once the catch 140 is withdrawn from the groove 175'', the rail section 162'' is rotated about its longitudinal axis until the tab 182'' is aligned with the groove 175'' to permit pivoting of the rail section about its terminal end.

Alternatively, the collapsible uprights 80 of the upright frame 70 of each end assembly may include a one way safety hinge. The safety hinge is similar to the action of the central coupler 166. That is, the one way safety hinge precludes articulation or collapsing of the upright 80 when the safety hinge is in the operative position. In the upright 80 employing the safety hinge, the lower end of the lower section 84 includes a radial slot. The radial slot extends approximately 90° of the periphery of the lower section. Similarly, the upper end of the upper section 82 includes a radial slot. The hinge 88 connects the upper section 82 to the lower section 84.

The upper end of the upper section 82 is received within a depending portion of the crossbar 110. A screw or similar pin is passed through the crossbar to project into the radial slot 83. The screw retains the upper section 82 relative to the crossbar 110, while permitting rotation of the upper section about is longitudinal axis. Similarly, the lower end of the lower section 84 is received within the end base 50. A screw or similar aim is passed through the end base to project into the radial slot. As the screw passes into the radial slot, the screw retains the lower section 84 relative to the end base 50. The hinge 88 defines an elongate U-shaped channel which receives the lower end of the upper section 82 and the upper end of the lower section 84.

When the closed portion of the safety hinge faces toward the opposing end assembly, the upper section may pivot about the safety hinge and away from the opposing end assembly. In the operative position, the closed portion of the hinge is rotated towards the near side of the playpen so that the open portion of the hinges within each end assembly face each other. Therefore, in the operative position, the hinges provide that the upper sections 82 within each upright may only rotate toward each other, however, as each upper section is affixed to the upper cross bar 110, which has a fixed length, the uprights are effectively locked into the operative position. To close the playpen the hinges are rotated to permit folding of the upper and lower portions as previously described.

While a preferred embodiment of the invention has been shown and described with particularity, it will be appreciated that various changes and modifications may suggest themselves to one having downward direction toward a center vertical leg located at each end and the side portions are pivotal inward bringing the two folded end portions together, to thereby fold the playpen.

What is claimed is:

1. A ball and socket joint comprising:

a rail member having a ball mounted on one end thereof; and a base member having a socket defined therein, said socket defining a radial slot in said base member permitting pivoting of said rail section relative to said base member between a first position and a second position, and said socket permitting rotation of said ball in said socket to permit rotation of said rail member about the longitudinal axis between a locked orientation and an unlocked orientation when said rail member is in the first position, and wherein when said rail section is in the locked orientation said rail section is retained in the first position and when said rail section is in the unlocked orientation said rail section is free to pivot relative to said base member between the first and second positions.

2. A ball and socket joint according to claim 1, wherein said base member comprises a retaining plate and said ball is retained within said socket by said retaining plate.

3. A ball and socket joint according to claim 1, wherein said base member comprises an elongated tab protruding into said socket and said ball has a groove defined on a periphery of said ball, said groove shaped to be engaged by said elongated tab.

4. A ball and socket joint according to claim 3, wherein said groove is generally T-shaped and has an elongated portion sized to receive said elongated tab and permit said elongated tab to slide in said elongated portion to permit pivoting of said rail member when said rail member is in the unlocked orientation, said elongated portion terminating at one end thereof in a wide portion having a width greater than a length of said elongated tab, wherein when said rail member is in the locked orientation said wide portion receives said elongated tab and prevents said elongated tab from sliding in said elongated portion thereby preventing pivoting of said rail member.

5. A ball and socket joint according to claim 1, further comprising a locking mechanism which selectively prevents rotation of said rail member when said rail member in is the locked position, thereby preventing pivoting of said rail member.

6. A ball and socket joint according to claim 5, wherein said locking mechanism comprises a biased catch coupled to said base member, said catch biased into contact with said ball, and adapted to engage said ball when said rail member is in the locked orientation to prevent rotation of said rail member.

7. A ball and socket joint according to claim 6, wherein said catch has an elongated member that is biased into engagement with said groove when said rail member is in the locked orientation to prevent rotation of said rail member, said catch being selectively operable to retract said elongated member from said groove to permit rotation of said member.

8. A ball and socket joint according to claim 1, in combination with a collapsible playpen frame movable between a collapsed position and an operative position, said playpen frame further comprising:

a first end assembly and a second end assembly, each end assembly including an end base for contacting a supporting surface and an upper cross bar, one said end base forming said base member;

articulated uprights extending between the end base and the upper cross bar in each end assembly for selectively separating the upper cross bars by a distance greater than the distance between the end bases, the articulated uprights adapted to be substantially vertical in the operative position of the playpen;

lower articulated rails, one said rail forming said rail section, extending between the end bases for disposing the end bases in a parallel spaced apart orientation in the operative position and a parallel adjacent orientation in the collapsed position; and upper articulated rails extending between the upper cross bars for connecting the upper cross bars of the first and second end assembly;

the uprights and the upper and lower rails adapted to orient the upper cross bar and the end base of each end assembly in a spaced apart parallel orientation in the operative position, and an adjacent parallel orientation in the collapsed position wherein the distance between the upper cross bars is greater than the distance between the end bases in the collapsed position of the playpen.

9. A ball and socket joint according to claim 1, wherein the rail member and the base member are components of a portable playpen.

10. A ball and socket joint comprising:

a rail member having a ball mounted on one end thereof; and a base member having a socket therein, said socket defining a radial slot in said base member permitting pivoting of said rail section relative to the base between a first position and a second position, and said socket permitting rotation of said ball in said socket to permit rotation of said rail member about the longitudinal axis between a locked orientation and an unlocked orientation when said rail member is in the first position, wherein when said rail section is in the locked orientation said rail section is retained in the first position and when said rail section is in the unlocked orientation said rail section is free to pivot relative to said base member between the first and second positions; and a locking mechanism which selectively prevents rotation of said rail member when said rail member in is the locked position, thereby preventing pivoting of said rail member;

wherein said base member comprises an elongated tab protruding into said socket and said ball has a groove defined on the periphery of said ball, said groove shaped to be engaged by said elongated tab; and wherein said groove is generally T-shaped and has an elongated portion sized to receive said elongated tab and permit said elongated tab to slide in said elongated portion to permit pivoting of said rail member when said rail member is in the unlocked orientation, said elongated portion terminating at one end thereof in a wide portion having a width greater than a length of said elongated tab, wherein when said rail member is in the locked orientation said wide portion receives said elongated tab and prevents said elongated tab from sliding in said elongated portion thereby preventing pivoting of said rail member.

11. A ball and socket joint according to claim 10, wherein said locking mechanism comprises a biased catch coupled to said base member, said catch biased into contact with said ball, and adapted to engage said ball when said rail member is in the locked orientation to prevent rotation of said rail member.

12. A ball and socket joint according to claim 11, wherein said catch has an elongated member that is biased into engagement with said groove when said rail member is in the locked orientation to prevent rotation of said rail member, said catch being selectively operable to retract said elongated member from said groove to permit rotation of said rail member.

13. A ball and socket joint according to claim 10, wherein the rail member and the base member are components of a portable playpen.

* * * * *